US008939800B2

(12) United States Patent
Hoppmann

(10) Patent No.: US 8,939,800 B2
(45) Date of Patent: Jan. 27, 2015

(54) CONNECTION TERMINAL

(75) Inventor: Ralph Hoppmann, Bad Oeynhausen (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 80 days.

(21) Appl. No.: 13/814,961

(22) PCT Filed: Jun. 30, 2011

(86) PCT No.: PCT/EP2011/003221
§ 371 (c)(1),
(2), (4) Date: Feb. 8, 2013

(87) PCT Pub. No.: WO2012/019671
PCT Pub. Date: Feb. 16, 2012

(65) Prior Publication Data

US 2013/0143433 A1 Jun. 6, 2013

(30) Foreign Application Priority Data

Aug. 9, 2010 (DE) ..... 10 2010 033 808

(51) Int. Cl.
*H01R 29/00* (2006.01)
*H01R 9/24* (2006.01)
*H01R 9/26* (2006.01)

(52) U.S. Cl.
CPC ..... *H01R 9/2458* (2013.01); *H01R 9/2675* (2013.01); *H01R 9/2666* (2013.01)
USPC ..... 439/709; 439/513

(58) Field of Classification Search
USPC ..... 439/709, 513, 507
See application file for complete search history.

(56) References Cited

U.S. PATENT DOCUMENTS

| | | | | |
|---|---|---|---|---|
| 4,171,861 | A * | 10/1979 | Hohorst | 439/94 |
| 5,722,862 | A * | 3/1998 | Glathe et al. | 439/709 |
| 8,460,038 | B2 * | 6/2013 | Eisert et al. | 439/716 |
| 8,651,902 | B2 * | 2/2014 | Wu | 439/811 |
| 2011/0062011 | A1 * | 3/2011 | Pollmann | 200/554 |

FOREIGN PATENT DOCUMENTS

| | | | |
|---|---|---|---|
| DE | 2825291 | A1 | 12/1979 |
| DE | 10255674 | A1 | 6/2004 |
| EP | 0150518 | A1 | 8/1985 |

OTHER PUBLICATIONS

European Patent Office, International Search Report in International Patent Application No. PCT/EP2011/003221 (Oct. 26, 2011).

* cited by examiner

*Primary Examiner* — Gary Paumen
(74) *Attorney, Agent, or Firm* — Leydig, Voit & Mayer, Ltd.

(57) ABSTRACT

A connection terminal includes a bushar, wherein at least one insertion opening for accommodating a bridging device is formed on the bushar, wherein the insertion opening is designed in the form of a material passage having a hole collar, wherein the hole collar of the material passage encircles the insertion opening. The hole collar extends away from the surface of the bushar in the opposite direction to the insertion direction of the bridging device.

5 Claims, 3 Drawing Sheets

CONNECTION TERMINAL

CROSS REFERENCE TO RELATED APPLICATIONS

This application is a U.S. national phase application under 35 U.S.C. §371 of International Application No. PCT/EP2011/003221, filed on Jun. 30, 2011, and claims benefit to German Patent Application No. DE 10 2010 033 8083, flied on Aug. 9, 2010. The international application was published in German on Feb. 16, 2012, as WO 2012/019671 A1 under PCT Article 21(2).

The invention relates to a connection terminal, in particular a terminal block, having a busbar, wherein at least one through-opening for receiving a bridging device is formed on the busbar, wherein the through-opening is in the form of a material passage which has a hole collar, wherein the hole collar of the material passage is formed circumferentially around the through-opening.

Connection terminals of this kind, in particular terminal blocks, are usually latched to a supporting rail and provide a large number of clamping points for a space-saving distribution of potentials and currents. Bridging devices can be used to establish electrical contact between adjacent connection terminals or terminal blocks or between connection terminals or terminal blocks which are spaced apart from one another by other terminals. To this end, the busbars provided in the connection terminals or the terminal blocks are provided with one or more through-openings in the form of material passages which, when there are a plurality of material passages, are preferably arranged in a line in order to keep the design of the busbar as narrow as possible, this being required, for example, for passage busbars of terminal block arrangements which are closely adjacent to one another. Particularly narrow busbars of this kind have only narrow edge webs, which run in the busbar direction, in the region of the material passages, the current conducting cross sections of said edge webs generally not being adequate. This disadvantage is compensated for by the hole collars of the material passages, the hole collar cross sections of said hole collars at the same time also being current conducting cross sections, with the result that the cross sections of the edge webs and the cross sections of the hole collars altogether provide a sufficiently large current conducting cross section in the direction of the busbar. In this case, the hole collars of the material passages are, as shown in DE 28 25 291 A1, for example, formed on the lower side of the busbar which is arranged in the connection terminal, that is to say on that side of the busbar which points in the direction of the supporting rail, circumferentially around the through-opening and in the insertion direction of the bridging device into the through-opening or into the material passage.

In order to produce connection terminals, in particular terminal blocks, of this kind in as economical a manner as possible, one object is to reduce the material costs of a connection terminal of this kind. If the height of the hole collar of the material passage is reduced for this purpose, this leads to a reduction in the current conducting cross section, as a result of which it is no longer possible to ensure reliable contact.

The invention is therefore based on the object of providing a solution by means of which the material costs of a connection terminal, in particular a terminal block, are reduced without reducing the current conducting cross section.

In a connection terminal, in particular terminal blocks, of the kind described in more detail in the introductory part, the object is achieved in that the hole collar extends away from the surface of the busbar in the opposite direction to the insertion direction of the bridging device.

Since, according to the invention, the hole collar of the material passage is drawn or extends upward in the opposite direction to the insertion direction of the bridging device as seen from the surface of the busbar, the distance between the busbar and the supporting rail can be reduced in comparison with a connection terminal having a hole collar which is provided on the busbar in the insertion direction, without the required length of an air and creepage clearance between the busbar and the supporting rail being undershot. Therefore, despite a reduction in the distance between the busbar and the supporting rail, and therefore a reduction in the dimensions of the housing of the connection terminal, a sufficiently large air and creepage clearance can still be provided between the busbar and the supporting rail.

Therefore, in the solution according to the invention, the hole collar is provided on that side of the busbar which is averted from the supporting rail on which the connection terminal is arranged. If, as is otherwise customary, the hole collar is provided on that side of the busbar which faces the supporting rail, the air and creepage clearance between the busbar and the supporting rail is shortened. In order to be able to ensure a sufficiently large air and creepage clearance, the height of the protective conductor element between the busbar and the supporting rail has to be designed to be larger in this case, as a result of which the level of the busbar is changed and more material is required for the protective conductor element. However, the expenditure on material, in particular for the protective conductor element, can be reduced by means of the solution according to the invention, this in turn leading to a reduction in material costs. The current conducting cross section of the hole collar does not have to be changed or reduced in this case. In contrast, the current conducting cross section of the hole collar can be increased since, in particular, the height of the hole collar now no longer has any influence on the air and creepage clearance between the busbar and the supporting rail. The inventive design of the material passage on the busbar is also advantageous particularly when one or more blind holes for receiving the bridging device which is routed through the through-opening is/are provided below the busbar, in the insertion direction of the bridging device, since the blind holes can therefore be formed independently of the design of the hole collar of the material passage in the housing of the connection terminal. It is possible to mount the busbar without further expenditure, even in the case of closed blind holes, by forming the hole collar of the material passage in the opposite direction to the insertion direction of the bridging device on the upper side of the busbar, which faces the supporting rail. The bridging device used can be the same bridging devices as are used in the known connection terminals, with the result that it is not necessary to adapt the design of the known bridging devices to the connection terminal according to the invention. Therefore, the same bridging devices from existing connection terminals can be used, without additional components being required or the dimensions of the connection terminal having to be designed to be larger.

The bridging device can be a bridge or else an electrical conductor with a clamping spring. If the bridging device has a clamping spring, the clamping spring can have both limbs, for example, accommodated in the material passage. As an alternative, it is also possible for the abutment limbs of the clamping spring to be fixed outside the material passage, while the clamping limb enters the material passage.

Advantageous refinements of the invention are specified in the dependent claims.

According to one preferred refinement of the invention, an insertion slope or a rounded insertion portion is provided on at least one inner wall face of the hole collar at an end of the hole collar which is averted from the busbar. Providing an insertion slope or a rounded insertion portion at that end of the hole collar which is averted from the busbar in the region of an inner wall face of the hole collar makes it possible, when the bridging device is inserted into the through-opening or into the material passage, for the leading end of the bridging device to be guided in a deliberately guided manner, in particular in a sliding manner, into the material passage and through the through-opening which is formed on the busbar, as a result of which forces required for inserting the bridging device can be reduced and any existing surface coating on the inner wall face of the hole collar may possibly be protected against damage. On account of an insertion slope or rounded insertion portion being formed directly on the hole collar of the material passage, it is no longer necessary to form insertion aids in the housing of the connection terminal itself, as a result of which production of the housing can be simplified since insertion aids which are otherwise usually formed in the housing make it more difficult to remove the housing from the casting die. In order to form an insertion slope, the inner wall face can be provided with a phase at that end of the hole collar which is averted from the busbar. In order to form a rounded insertion portion, the inner wall face can be provided with a radius at that end of the hole collar which is averted from the busbar.

According to a further preferred refinement of the invention, the insertion slope or rounded insertion portion is formed circumferentially around that end of the hole collar which is averted from the busbar. When the insertion slope or rounded insertion portion is designed in a circumferential manner, all the inner wall faces of the hole collar are provided with an insertion slope or a rounded insertion portion at that end of the hole collar which is averted from the busbar. As a result, all the side faces or inner wall faces of the hole collar or of the material passage can be used to establish contact between the bridging device and the busbar, as a result of which the number of possible contact points can be increased or can be used as an alternative contact point for further components, such as test plugs.

According to one preferred refinement of the invention, provision is further made for the hole collar to be produced using a Flowdrill method. When the hole collar or the material passage is produced using the Flowdrill method, a passage opening is first drilled into the busbar, the diameter of said passage opening being several times smaller than the diameter of the final passage opening or of the material passage. The existing passage opening is then drilled with a special flow drill using the Flowdrill method, also called the friction drilling technique. During the drilling process, some of the hot and liquid material which is excavated from the hole is transported upward by the drill to the surface of the busbar, as a result of which the hole collar is formed. A material passage which is formed with a hole collar can be made in a busbar by means of the Flowdrill method in a simple manner with a few work steps.

According to a further advantageous refinement of the invention, provision is also made for the hole collar, in addition to extending in the opposite direction to the insertion direction of the bridging device, to extend away from the surface of the busbar in the direction of the insertion direction of the bridging device. On account of the hole collar extending in both directions in this refinement, the hole collar and therefore the material passage can be designed to be longer, as a result of which improved and more reliable contact can be provided. In this case, the production of a hole collar, which extends in both directions, can preferably be produced using the above-described Flowdrill method since, in this method, hot and liquid material which is excavated from the busbar during drilling flows not only in the drilling direction but also in the opposite direction to the drilling direction on account of the drill moving forward and the force of gravity. As a result, it is possible to form a hole collar or a material passage which extends both in the opposite direction to the insertion direction of the bridging device and in the insertion direction of the bridging device in one work cycle or work step.

The invention will be explained in greater detail with reference to the accompanying drawings on the basis of a preferred embodiment.

Figure 1:
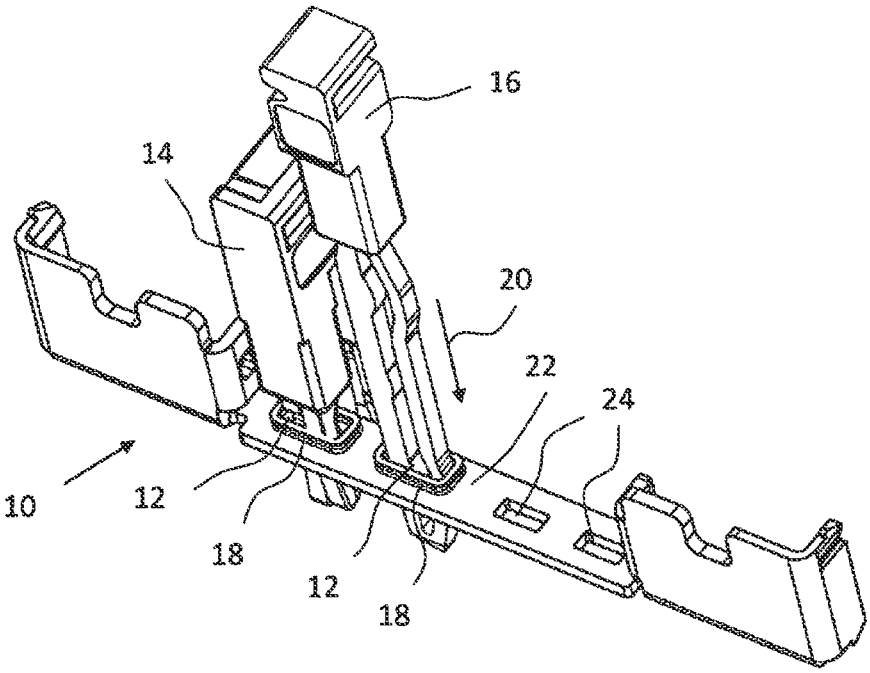
FIG. 1 shows a schematic illustration of a busbar having a material passage according to the invention which is formed in said busbar, has a hole collar and has a bridging device inserted into it.

FIG. 1 shows a busbar 10 having two through-openings 12 into which a bridging device 14 and a test plug 16 are inserted. The bridging device 14 is illustrated in the form of a bridge in the embodiment shown here. However, it may also be designed in the form of a spring element—not illustrated here—which is fitted in one or more through-openings 12.

The passage opening 12 is in the form of a material passage which has a hole collar 18. The hole collar 18 of the material passage is of substantially square design and is arranged closed in the manner of a ring circumferentially around the through-opening. In this case, the hole collar 18 of the material passage is formed on the busbar 10 in such a way that the hole collar 18 extends away from the surface 22 of the busbar 10 in the opposite direction to the insertion direction 20 of the bridging device 14.

Figure 4:
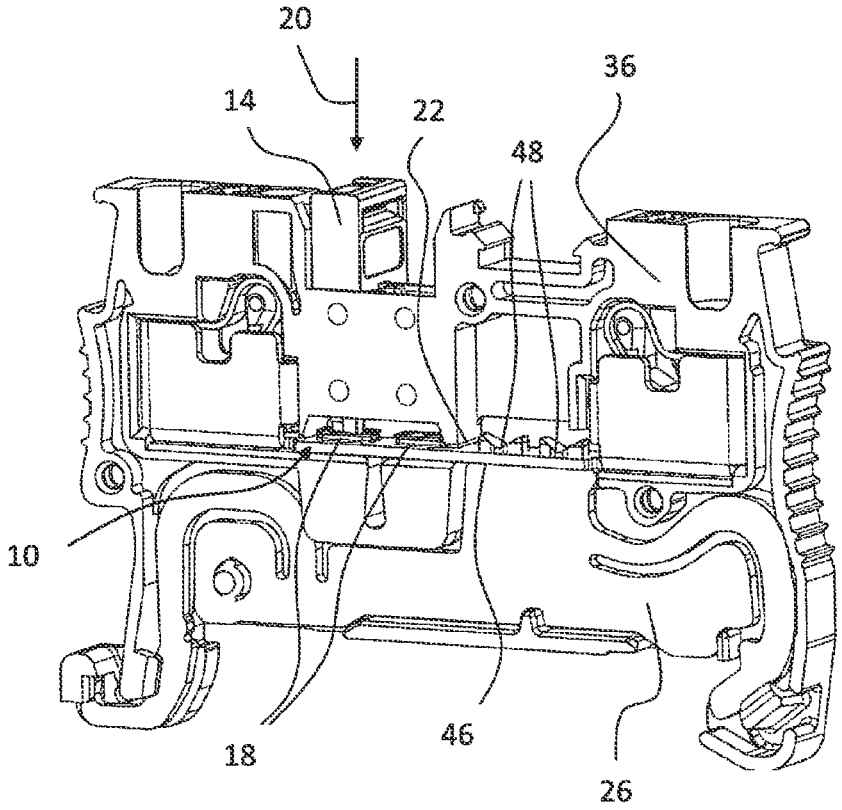
FIG. 4 shows a further schematic illustration of a longitudinal section through a connection terminal according to the invention.

In addition to the through-openings 12, two further passage openings 24 are formed in the busbar 10, it being possible, for example, for a protective conductor element 26 of a connection terminal to be connected to the busbar 10 by means of latching pins 48 via said further passage openings, as shown in FIG. 4.

In this case, the through-openings 12 and the passage openings 24 are provided next to one another in a line in the busbar 10 in the embodiment shown here.

Figure 2:
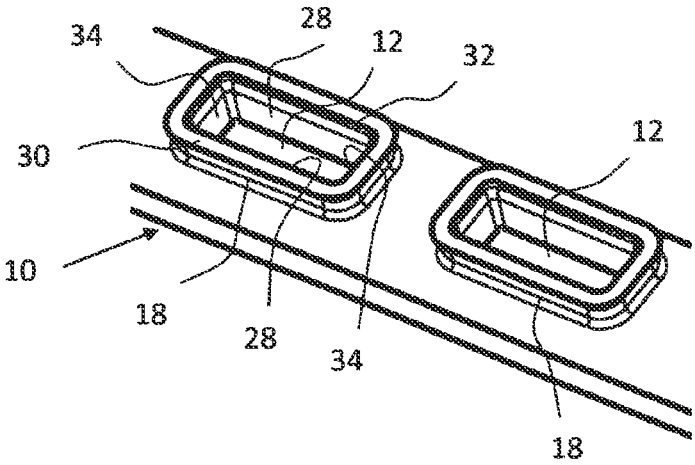
FIG. 2 shows an enlarged schematic illustration of the hole collar of the material passage according to the invention.

FIG. 2 shows an enlarged illustration of the hole collar 18 of the material passage, wherein said figure shows that an insertion slope 32 in the form of a phase is formed on all four inner wall faces 28, 34 of the hole collar 18 at an end 30 of the hole collar 18 which is averted from the busbar 10. The insertion slope 32 is therefore formed circumferentially at that end 30 of the hole collar 18 which is averted from the busbar 10. When a bridging apparatus 14 is inserted into the material passage or the through-opening 12, said bridging apparatus can therefore be deliberately inserted into the material passage along the insertion slopes 32. The insertion slope 32 therefore serves as an insertion aid. In addition, the number of contact points, for example for the bridging device 14 which is inserted into the through-opening 12 and for the test plug 16 which is inserted into the through-opening 12, is also increased by the circumferentially provided insertion slopes.

The contact points or contact zones between the bridging device 14 and the material passage are preferably provided on those inner wall faces 28 of the hole collar 18 or of the through-opening 12 which run on the longitudinal side of the hole collar 18. The contact points or contact zones between a test plug 16 and the material passage are preferably provided on those inner wall faces 34 of the hole collar 18 or of the through-opening 12 which run on the transverse side of the hole collar 18.

Figure 3:
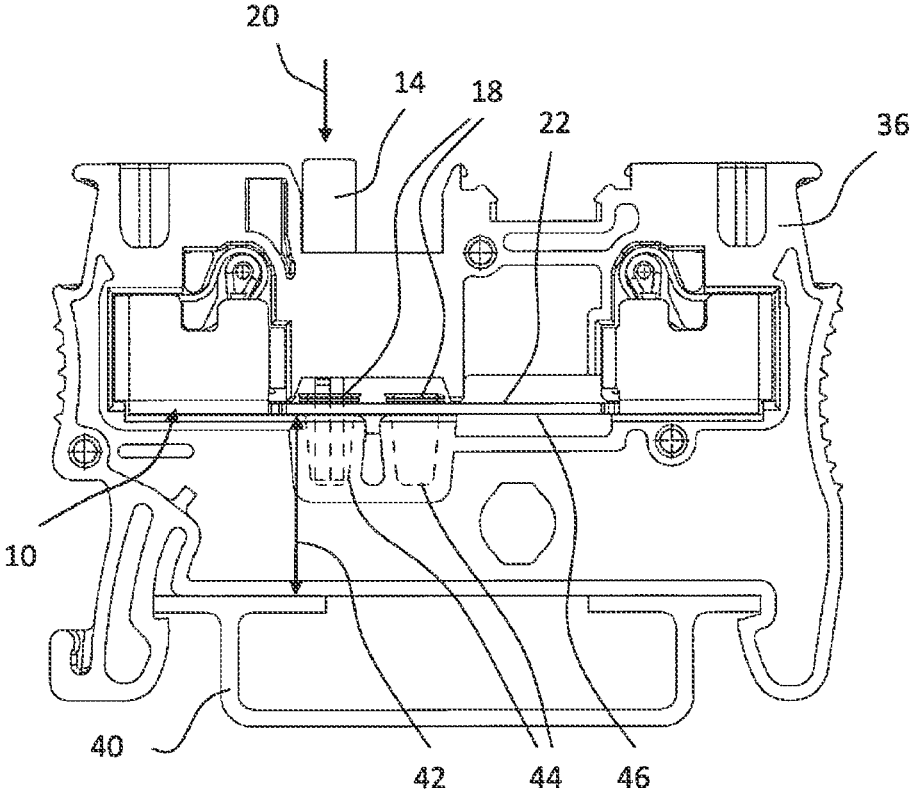
FIG. 3 shows a schematic illustration of a longitudinal section through a connection terminal according to the invention.

FIG. 3 and FIG. 4 show the busbar 10 which is shown in FIG. 1 and FIG. 2 in a manner arranged in a housing 36 of a connection terminal, in particular a terminal block. The connection terminal has its housing 36 arranged on a supporting rail 40, as shown in FIG. 3. The required distance between the supporting rail 40 and the busbar 10 of the connection terminal is provided by a required length of an air and creepage clearance 42, as shown in FIG. 3. The hole collars 18 of the material passages in the two through-openings 12—not visible in FIG. 3 and FIG. 4—provided here extend in the opposite direction to the insertion direction 20 of the bridging device 14. In the state inserted into the connection terminal, the hole collars 18 therefore extend away from that surface 22 of the busbar 10 which is averted from the supporting rail 40. On account of the hole collars 18 extending away from that surface 22 of the busbar 10 which is averted from the supporting rail 20, the distance between the busbar 10 and the supporting rail 40 does not become smaller when the hole collars 18 are provided, and therefore the busbar 10 does not have to be arranged at a higher level, as is the case when the hole collar 18 is arranged on the surface 46 which faces the supporting rail 40. As a result, it is thus also no longer necessary to design the protective conductor element 26 between the supporting rail 40 and the busbar 10 to be larger, as a result of which both the expenditure on material and the material costs can be reduced.

As can be seen in FIG. 3, blind holes 44—indicated by a dashed line—are provided beneath the busbar 10, it being possible for the bridging device 14 inserted into the through-openings 12 and, for example, also a test plug 16—not shown in FIG. 3—to project into said blind holes. In this case, the hole collars 18 of the material passages are arranged on that side of the busbar 10 which is averted from the blind holes 44, with the result that the height and the shape of the hole collar 18 can be formed independently of the design of the blind holes 44.

LIST OF REFERENCE SYMBOLS

Busbar 10
Through-opening 12
Bridging device 14
Test plug 16
Hole collar 18
Insertion direction 20
Surface 22
Passage opening 24
Protective conductor element 26
Inner wall face 28
End 30
Insertion slope 32
Inner wall face 34
Housing 36
Supporting rail 40
Air and creepage clearance 42
Blind hole 44
Surface 46
Latching pin 48

The invention claimed is:

1. A connection terminal, in particular a terminal block, having a busbar, wherein at least one through-opening for receiving a bridging device is formed on the busbar, wherein the through-opening is in the form of a material passage which has a hole collar, wherein the hole collar of the material passage is formed circumferentially around the through-opening, wherein the hole collar extends away from the surface of the busbar in the opposite direction to the insertion direction of the bridging device.

2. The connection terminal of claim 1, wherein an insertion slope or a rounded insertion portion is provided on at least one inner wall face of the hole collar at an end of the hole collar which is averted from the busbar.

3. The connection terminal of claim 2, wherein the insertion slope or rounded insertion portion is formed circumferentially around that end of the hole collar which is averted from the busbar.

4. The connection terminal of claim 1, wherein the hole collar is produced using a Flowdrill method.

5. The connection terminal of claim 1, wherein the hole collar, in addition to extending in the opposite direction to the insertion direction of the bridging device, extends away from the surface of the busbar in the direction of the insertion direction of the bridging device.

* * * * *